US008258700B2

(12) United States Patent
Otsuka et al.

(10) Patent No.: US 8,258,700 B2
(45) Date of Patent: Sep. 4, 2012

(54) PLASMA DISPLAY PANEL

(75) Inventors: Akira Otsuka, Zama (JP); Takashi Sasaki, Hiratsuka (JP)

(73) Assignee: Hitachi, Ltd., Tokyo (JP)

( * ) Notice: Subject to any disclaimer, the term of this patent is extended or adjusted under 35 U.S.C. 154(b) by 529 days.

(21) Appl. No.: 12/597,769

(22) PCT Filed: May 7, 2007

(86) PCT No.: PCT/JP2007/000481

§ 371 (c)(1),
(2), (4) Date: Oct. 27, 2009

(87) PCT Pub. No.: WO2008/142728

PCT Pub. Date: Nov. 27, 2008

(65) Prior Publication Data

US 2010/0079056 A1 Apr. 1, 2010

(51) Int. Cl.
*H01J 17/49* (2012.01)
*H01J 17/48* (2006.01)

(52) U.S. Cl. ..... 313/582; 313/581; 313/584

(58) Field of Classification Search ..... 313/513, 313/514, 581, 582, 584, 586, 587, 634–635
See application file for complete search history.

(56) References Cited

U.S. PATENT DOCUMENTS

| | | | | |
|---|---|---|---|---|
| 6,200,182 | B1 | 3/2001 | Nanto et al. | |
| 6,586,879 | B1 * | 7/2003 | Shino et al. | 313/582 |
| 7,541,741 | B2 * | 6/2009 | An | 313/582 |
| 2006/0284546 | A1 * | 12/2006 | Kim | 313/500 |
| 2007/0279325 | A1 * | 12/2007 | Ryu et al. | 345/60 |

FOREIGN PATENT DOCUMENTS

| | | | |
|---|---|---|---|
| JP | 09-129142 | A | 5/1997 |
| JP | 2003-100222 | A | 4/2003 |
| JP | 2003-132796 | A | 5/2003 |
| JP | 2005-019008 | A | 1/2005 |
| JP | 2006-202627 | A | 8/2006 |
| JP | 2007-5297 | A | 1/2007 |

* cited by examiner

*Primary Examiner* — Anh Mai
*Assistant Examiner* — Nathaniel Lee
(74) *Attorney, Agent, or Firm* — Miles & Stockbridge P.C.

(57) ABSTRACT

A plasma display panel has a front substrate (3) and a back substrate (2) arranged opposed to each other through a discharge space (4). On the back substrate, a fluorescent layer (5) is formed. On the front substrate, display electrodes are formed extending in a horizontal direction, a discharge cell area is demarcated corresponding to the display electrodes, and a plurality of shielding films (13) extending in the horizontal direction are moreover formed at each position which is among the display electrodes and within the discharge cell area. When the distance between the shielding films and the fluorescent layer is set to be D, the width L of a shielding film and the distance S between the shielding films satisfy $0.58 \leqq L \leqq D$ and $D \leqq S \leqq 1.73D$. This reduces the reflectance ratio of outdoor daylight to improve lighted room contrast.

15 Claims, 13 Drawing Sheets

PLASMA DISPLAY PANEL

TECHNICAL FIELD

The present invention relates to a plasma display panel, and more particularly, to a plasma display panel having a simple structure and improved contrast.

BACKGROUND ART

Plasma display panels emit light by exciting a phosphor with ultraviolet light generated by plasma discharge. Their configuration consists of the formation of a phosphor on a back substrate and enabling light emitted from the phosphor to be visible from a front substrate. Since phosphors have a milky white color ranging from white to pale gray when not emitting light, in an environment in which ambient light attributable to indoor light is radiated onto the panel, the milky white phosphor irradiated by the ambient light is observed from the front substrate, and both light resulting from phosphor emission and reflected light in the phosphor caused by the ambient light are both present, thereby causing a decrease in contrast.

FIG. 1 is a cross-sectional view of a plasma display panel of the prior art that prevents decreases in contrast. A plasma display panel 1 has a back substrate 2 that has a fluorescent layer 5, and a front substrate 3 that has a display electrode (not shown), both the substrates 2 and 3 are arranged in mutual opposition with a discharge space 4 interposed therebetween, and has a filter 6 having a low light transmittance a on the front side of the panel 1.

As a result of providing the filter 6, the quantity of display light 7 emitted by the fluorescent layer 5 of the panel 1 is attenuated by passing through the filter 6 due to the low light transmittance thereof. However, indoor light or other ambient light 9 also passes through the filter 6 and ambient light 10 that has passed through the filter 6 radiates onto the fluorescent layer 5, and as a result thereof, reflected light 11 again passes through the filter 6 whereby reflected light 12 appears on the outside. In other words, display light is attenuated once ($\alpha$) by the filter 6, while ambient light 9 is attenuated twice ($\alpha^2$) by the filter 6. Accordingly, contrast, which is the ratio of ambient reflected light to display light, is improved as a result of providing the filter 6. However, the quantity of display light 8 itself is also attenuated by the filter 6.

Patent Documents 1 and 2 disclose configurations that prevent such decreases in contrast. In Patent Document 1, a dark-colored, band-shaped light-shielding film is formed in an area of an inverse slit between pairs of band-shaped display electrodes extending in the horizontal direction, and a phosphor on a back substrate is prevented from being visible through the inverse slit area. However, since a transparent electrode is formed in an emission area where electrical discharge between the pair of display electrodes occurs, and the phosphor on the back substrate is visible through the emission area, therefore, there are limitations on the degree to the contrast decrease prevention. In Patent Document 2, pairs of display electrodes extending in the horizontal direction are composed of metal bus electrodes and transparent electrodes, a third electrode extending in the horizontal direction is formed in a discharge area between the transparent electrodes, and it is proposed that a phosphor within the discharge area be shielded from ambient light by increasing the width of the third electrode in the discharge area between the transparent electrodes. The third electrode is held to a ground potential during panel driving, and together with operating as an auxiliary electrode that assists surface discharge of pairs of display electrodes, shields the phosphor in the discharge area from ambient light, thereby improving contrast.

In addition, in Patent Document 3, together with composing a pair of display electrodes with only metal bus electrodes instead of forming a transparent electrode that can result in high costs, the metal bus electrodes are composed of a plurality of electrode portions extending in the horizontal direction and linking portions that link the electrode portions in the manner of a ladder structure. The object of this Patent Document 3 is not to improve contrast.

Patent Document 1: Japanese Patent Application Laid-open No. H9-129142

Patent Document 2: Japanese Patent Application Laid-open No. 2006-202627

Patent Document 3: Japanese Patent Application Laid-open No. 2007-5297

There are expectations for the development of a plasma display panel capable of improving contrast in comparison with the example of the prior art and Patent Documents 1, 2 and 3 explained above. In Patent Document 1, there are limitations on improvement of contrast since there is no shielding of ambient reflected light in an emission area formed by discharge between a pair of display electrodes. In addition, in Patent Document 2, only a portion of an emission area is shielded with an auxiliary electrode, and since a fluorescent layer on a back substrate is still visible from the side of a front substrate in other portions of the emission area, considerable improvements in contrast cannot be expected. In addition, in Patent Document 3, a configuration for improving contrast is not described.

DISCLOSURE OF THE INVENTION

Therefore, an object of the present invention is to provide a plasma display panel having a simple structure and improved contrast.

In order to attain the above object, according to a first aspect of the present invention, a plasma display panel comprising: a front substrate and a back substrate arranged opposed to each other with a discharge space interposed therebetween, wherein a fluorescent layer is formed on the back substrate, a plurality of display electrodes extending in the horizontal direction are formed on the front substrate, and a discharge cell area is demarcated corresponding to the display electrodes, a plurality of shielding films extending in the horizontal direction are respectively formed between the display electrodes and within the discharge cell area on the front substrate, and when the distance between the shielding films and the fluorescent layer in the discharge space is defined as D, then a width L of the shielding films and a spacing S of the shielding films satisfy the relationships of $0.58D \leqq L \leqq D$ and $D \leqq S \leqq 1.73D$.

In the above first aspect, according to a preferred embodiment, the plurality of display electrodes are bus electrodes containing a metal material, and a width Ld of the plurality of display electrodes and a spacing Sd between the display electrodes and the shielding films adjacent thereto satisfy the relationships of $0.58D \leqq Ld \leqq D$ and $D \leqq Sd \leqq 1.73D$.

In the above first aspect, according to a preferred embodiment, the plurality of display electrodes are electrically conductive bus electrodes containing a metal material, transparent electrodes connected to the bus electrodes are formed in an area between the bus electrodes on the front substrate, and the plurality of shielding films are in the form of stripes and are arranged in the area between the bus electrodes.

In the above first aspect, according to a preferred embodiment, the plurality of display electrodes are electrically conductive bus electrodes, the plurality of shielding films are formed with an electrically conductive material, and a first shielding film and a second shielding film among the plurality of shielding films are respectively connected to a pair of the adjacent bus electrodes by connecting portions.

In the above first aspect, according to a preferred embodiment, the plasma display panel has stripe-like partitions extending in the vertical direction on the back substrate, and the discharge cell area is demarcated by the partitions and the bus electrodes, and additional shielding films corresponding to the locations of the partitions are formed on the front substrate.

In the above first aspect, according to a preferred embodiment, the plasma display panel has lattice-like partitions on the back substrate, and the discharge cell area is surrounded by the lattice-like partitions, and additional shielding films corresponding to the locations of the partitions are formed on the front substrate.

In the above first aspect, according to a preferred embodiment, the plasma display panel has lattice-like partitions on the back substrate, and the discharge cell area is surrounded by the lattice-like partitions, and the center of a shielding film unit composed of the plurality of shielding films is shifted upward from the center of the discharge cell area.

In the above first aspect, according to a preferred embodiment, the upper end of the shielding film unit is located lower than the fluorescent layer formed on sidewalls of the lattice-like partitions, and the shielding film unit is arranged so that shadows of the shielding films on the fluorescent layer formed by ambient light entering at a prescribed angle are located higher than the fluorescent layer formed on the sidewall of the lattice-like partition.

In the above first aspect, according to a preferred embodiment, the plurality of shielding films provided in the discharge cell area have a distance between the shielding films in the center of the discharge cell area that is longer than a distance between shielding films at the upper and lower edges of the discharge cell area.

In the above first aspect, according to a preferred embodiment, the plurality of shielding films provided in the discharge cell area have a width of the shielding films in the center of the discharge cell area that is narrower than a width of the shielding films at the upper and lower edges of the discharge cell area.

In the above first aspect, according to a preferred embodiment, the plurality of shielding films provided in the discharge cell area have a spacing S between the shielding films that does not satisfy the relationship of $D \leqq S \leqq 1.73D$ only in the center of the discharge cell area.

In order to attain the above object, according to a second aspect of the present invention, a plasma display panel comprises: a front substrate and a back substrate arranged opposed to each other with a discharge space interposed therebetween, wherein a fluorescent layer is formed on the back substrate, a plurality of display electrodes extending in the horizontal direction are formed on the front substrate, and a discharge cell area is demarcated corresponding to an area between adjacent display electrodes, the display electrodes have a plurality of light-shielding sustain electrodes extending in the horizontal direction and arranged on the discharge cell area, and connecting portions that extend from the display electrodes and connect the plurality of light-shielding sustain electrodes, and when the distance between the light-shielding sustain electrodes and the fluorescent layer in the discharge space is defined as D, then a width L of the light-shielding sustain electrodes and a spacing S of the light-shielding sustain electrodes satisfy the relationships of $0.58D \leqq L \leqq D$ and $D \leqq S \leqq 1.73D$.

In the above second aspect, according to a preferred embodiment, the electrodes extending in the horizontal direction, the light-shielding sustain electrodes and the connecting portions of the display electrodes are formed with the same metal material.

According to the present invention, since a plurality of shielding films are formed in a discharge cell area, and the width and spacing of the shielding films are set to prescribed ranges, together with partially preventing radiation of ambient light onto a fluorescent layer, reflection of ambient light radiated onto the fluorescent layer to the outside can also be partially prevented, thereby making it possible to considerably inhibit decreases in contrast caused by ambient light.

EXPLANATION OF REFERENCE NUMBER

1: Panel, 2: A back substrate, 3: A front substrate, 4: Discharge space, 5: Fluorescent material layer, 9: Ambient light, 13: Light-shielding film, 100: Viewing direction

Preferred Embodiments of the Invention

The following provides an explanation of embodiments of the present invention in accordance with the drawings. However, the technical scope of the present invention is not limited to these embodiments, but rather extends to those matters described in the claims and to equivalents thereof.

Principle of the Present Invention

Figure 2:
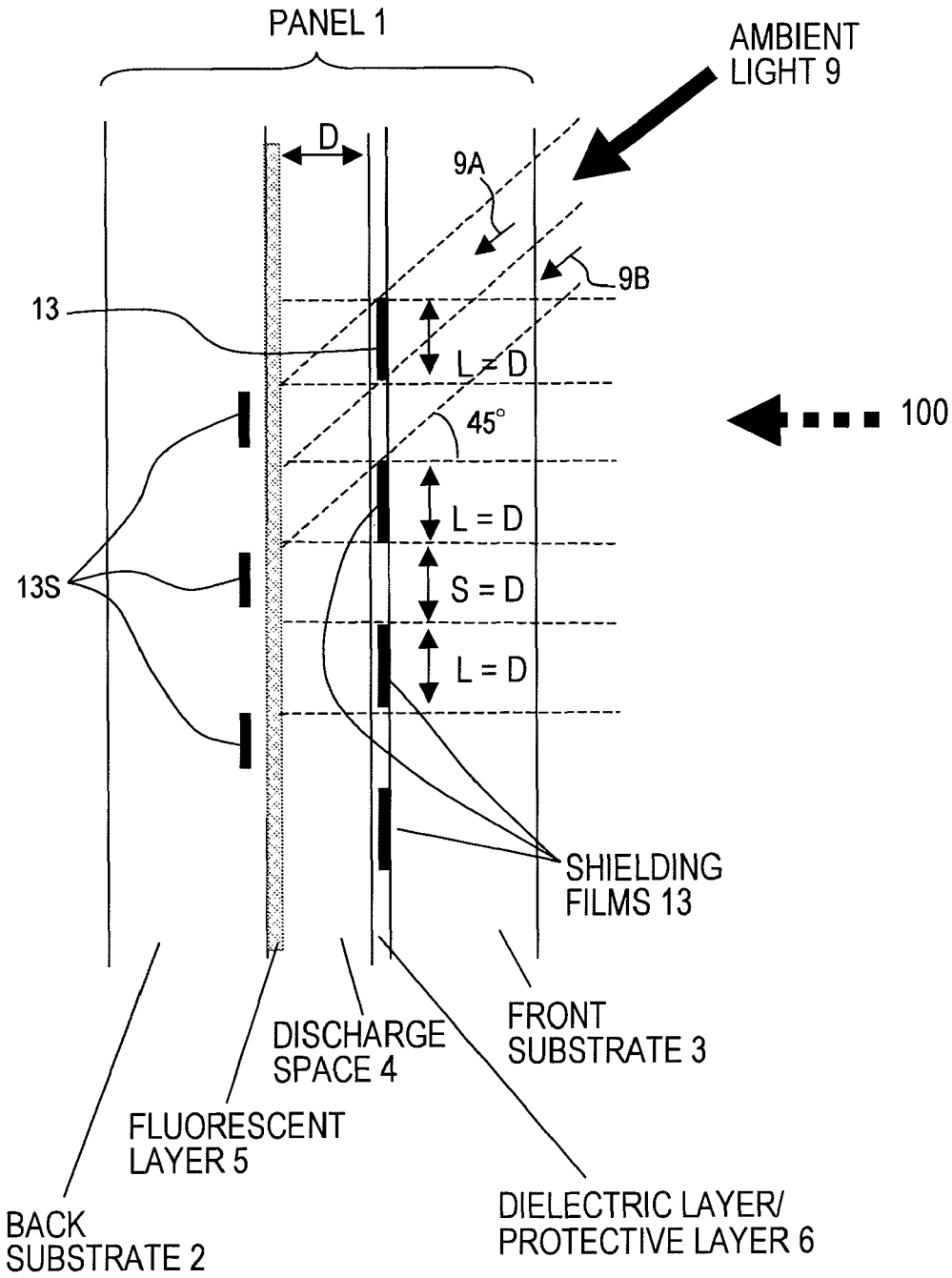
FIG. 2 is a schematic cross-sectional view of a plasma display panel in an embodiment of the present invention.

FIG. 2 is a schematic cross-sectional view of a plasma display panel in an embodiment of the present invention. A plasma display panel 1 has a front substrate 3 arranged on a front side with respect to a direction of observation 100, and a back substrate 2 arranged on a back side, and a discharge space 4, in which a discharge gas is sealed, is formed between the substrates. A fluorescent layer 5 is formed on the back substrate 2. In currently popular three-electrode, surface discharge type panels, a plurality of address electrodes (not shown) extending in the vertical direction (vertical direction on the paper) are formed on the back substrate 2, partitions are formed between the address electrodes, a plurality of display electrodes (not shown) extending in the horizontal direction (direction perpendicular to the paper) are formed on the front substrate 3, and the display electrodes are covered with a dielectric layer/protective layer 6.

In the above-mentioned panel 1, a plurality of stripe-like shielding films 13 extending in the horizontal direction (direction perpendicular to the paper) are provided on the front substrate 3. These shielding films 13 are composed of, for example, a dark-colored (or black) metal layer or fluorescent layer, and shield the fluorescent layer 5 exposed in the discharge space 4 from incident light 9A by blocking a portion of ambient light 9 that enters at a prescribed angle from the upper portion of the panel 1. In addition, the shielding films 13 prevent reflected light reflected by the fluorescent layer 5, in the form the ambient light 9B that enters from areas between the shielding films, from escaping to the outside. Nearly all of this reflected light can be blocked by optimizing the width L and the spacing S of the stripe-like shielding films 13. Moreover, since the shielding films 13 themselves have a dark color, the ambient light 9 is absorbed and hardly any ambient light is reflected by the shielding films.

Figure 1:
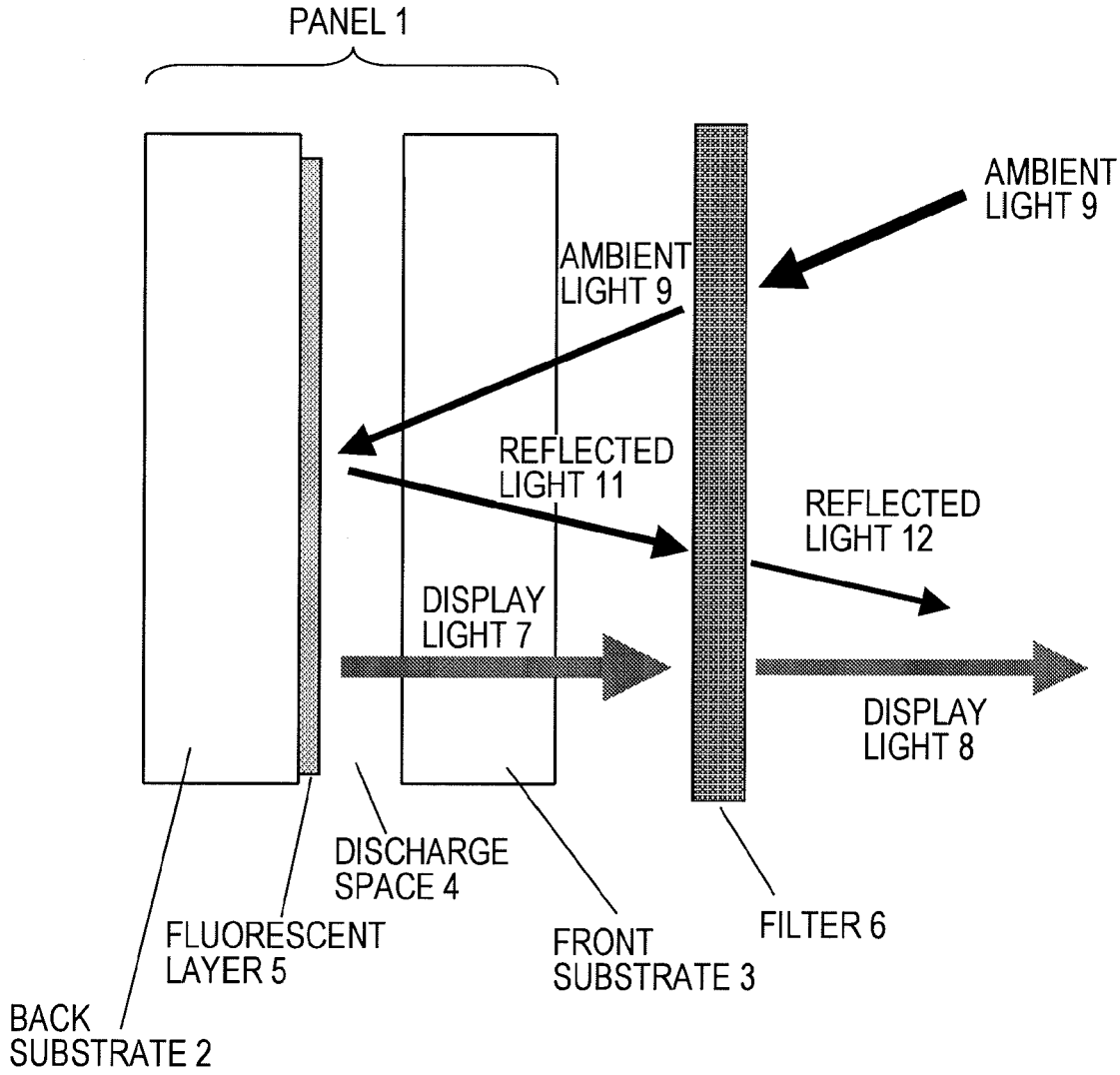
FIG. 1 is a cross-sectional view of a plasma display panel of the prior art that prevents decreases in contrast.

In the example of FIG. 2, the width L and the spacing S of the plurality of stripe-like shielding films 13 are designed such that S=D and L=D if a distance between the shielding films 13 on the side of the front substrate and the surface of the fluorescent layer 5 on the side of the back substrate is D. For example, if the distance D is taken to be 100 μm, then the width L and the spacing S of the plurality of stripe-like shielding films 13 are also 100 μm. In this configuration, in the case the ambient light 9 enters diagonally from above at 45°, shadows 13S on the fluorescent layer 5 of the shielding films 13 with respect to the ambient light 9A completely coincide with the locations of the areas S between the shielding films 13 in the direction of observation 100. In addition, in the direction of observation 100, areas irradiated by ambient light 9B on the fluorescent layer 5 completely coincide with the locations of the adjacent shielding films 13. Thus, ambient light reflected by the fluorescent layer 5 does not escape to the outside. Consequently, although approximately 50% of display light generated by the panel 1 as a result of electrical discharge is shielded by the shielding films 13, daylight contrast (contrast between a panel emission area and non-emission area in a bright room illuminated by indoor light), which is the ratio between that display light and reflected ambient light, increases to theoretical infinity. Contrast is therefore improved considerably in comparison with the case of providing a filter as shown in FIG. 1.

As has been described above, by providing a plurality of stripe-like shielding films 13, which satisfy the above-mentioned equation S=L=D, within a discharge cell area corresponding to two display electrodes, daylight contrast can be improved considerably with respect to ambient light at 45°.

Figure 3:
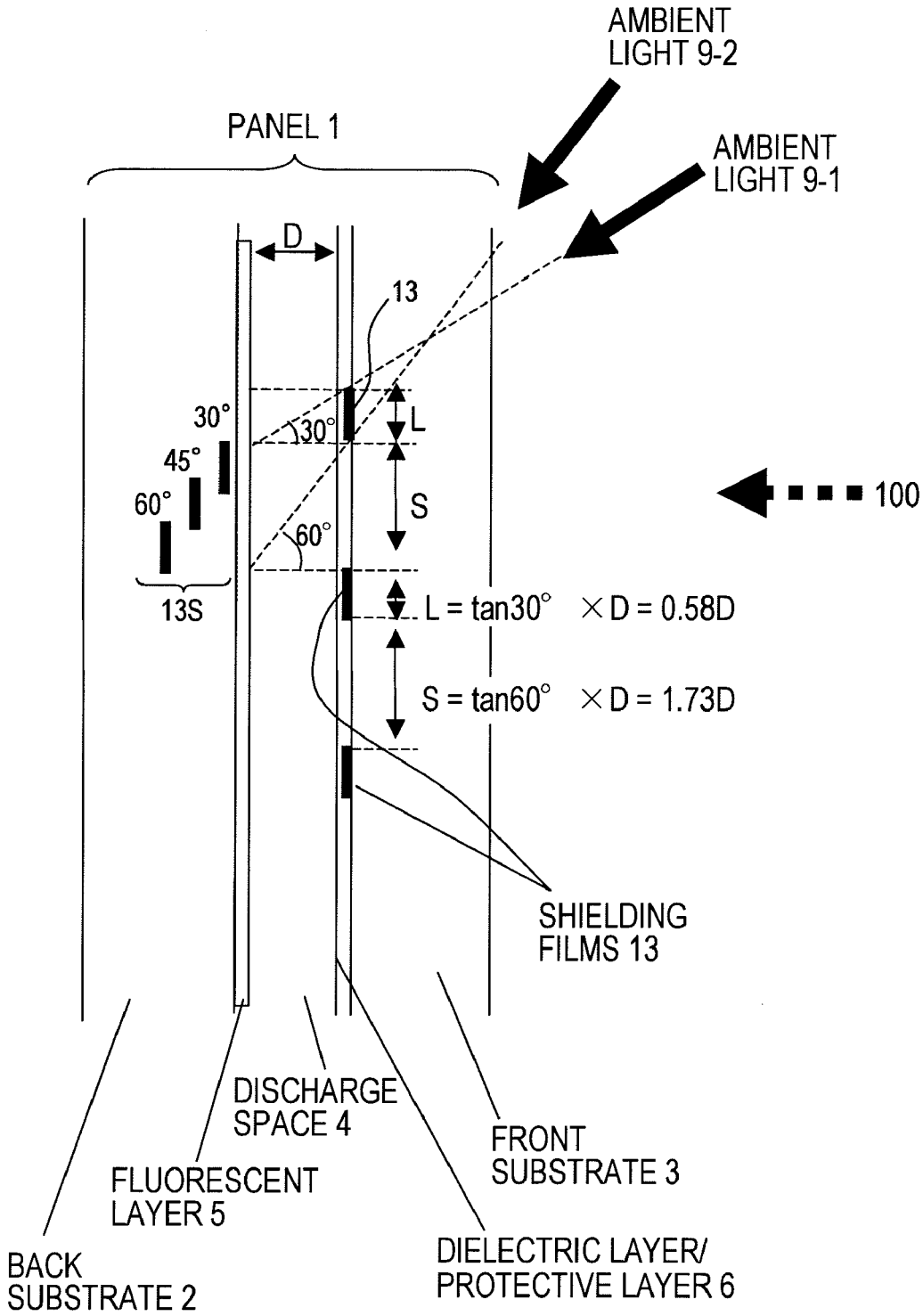
FIG. 3 is a schematic cross-sectional view of a plasma display panel in another embodiment of the present invention.

FIG. 3 is a schematic cross-sectional view of a plasma display panel in another embodiment of the present invention. In the example of FIG. 2, ambient light was assumed to enter diagonally from above at 45°, and it was explained that the contrast was improved considerably when the width L and the spacing S of shielding films were such that S=L=D. However, the incident angle of ambient light differs corresponding to the environment in which the plasma display panel is installed. Therefore, an explanation is provided of the optimum values of the width L and the spacing S of the shielding films when assuming the incident angle of ambient light to be within the range of 30° to 60°.

In the case the incident angle is 30° as in the case of ambient light 9-1, when L=S=D×tan 30≅0.58D, the shadows 13S of the shielding films 13 completely coincide with the locations of the areas S between the shielding films, reflected ambient light is substantially zero, and contrast can be improved considerably in the same manner as FIG. 2. Similarly, in the case the incident angle is 60° as in the case of ambient light 9-2, when L=S=D×tan 60≅1.73D, the shadows 13S of the shielding films 13 completely coincide with the locations of the areas S between the shielding films, and contrast can be improved considerably in the same manner as FIG. 2.

As shown in FIG. 3, if the plurality of stripe-like shielding films 13 are such that L=D×tan 30≅0.58D and S=D×tan 60≅1.73D, even if the incident angle of the ambient light 9 is within the range of 30° to 60°, when viewed from the direction of observation 100, the shadows 13S on the fluorescent layer 5 of the shielding films 13 are not concealed by the back side of the shielding films 13 that have formed shadows and are also not concealed by the back side of adjacent shielding films 13 there below. In other words, in the case of ambient light at an incident angle of 30° to 60°, the shadows 13S are located in any of the areas S between adjacent shielding films 13 as shown in the drawings, and only light reflected by the fluorescent layer 5, excluding the shadows 13S in the areas S, can be seen from the direction of observation 100. Accordingly, if the incident angle of ambient light is within the range of 30° to 60°, the quantity of reflected ambient light is constant.

In the case of a configuration in which L=0.58D and S=1.73D as described above, transmittance α of display light emitted by the panel 1 attributable to the plurality of shielding films 13 is:

$$\alpha=S/(L+S)=1.73D/(1.73D+0.58D)\cong 0.7489.$$

In addition, since the fluorescent layer 5, excluding the shadows 13S projected on the fluorescent layer 5, can be seen from the direction of observation 100 through the areas between the shielding films 13, reflectance ratio β of the ambient light 9 is:

$$\begin{aligned}\beta &= (L-S)/(L+S)\\ &= (1.73D-0.58D)/(1.73D+0.58D)\\ &\cong 0.4978.\end{aligned}$$

On the other hand, if the transmittance of the filter shown in FIG. 1 is taken to be 0.5, then the transmittance of the display light is 0.5 and the reflectance ratio of reflected light is the square of 0.5, or 0.25. Accordingly, when compared on the basis of $\alpha P/\sqrt{\beta}$, which indicates a standardized daylight contrast (where, P represents the quantity of display light, α represents transmittance, and β represents the reflectance ratio), the daylight contrast in the case of a filter having transmittance of 0.5 becomes 1.0P, and since the daylight contrast is 1.06P in the example of FIG. 3, the example of FIG. 3 improves daylight contrast by about 6% as compared with the example provided with a filter having transmittance of 0.5. However, the improvement in contrast is smaller than the example in which shielding films were formed such that S=L=D in the case of an incident angle of 45° as in FIG. 2.

Therefore, as a result of having conducted extensive studies, the inventor of the present invention determined on the basis of the approach described above that when the width L and spacing S of a plurality of shielding films are designed such that 0.58D≦L≦D and D≦S≦1.73D, daylight contrast is maintained at a high level at an incident angle of ambient light within the range of 30° to 60°. The following provides an explanation of that approach.

Figure 4:
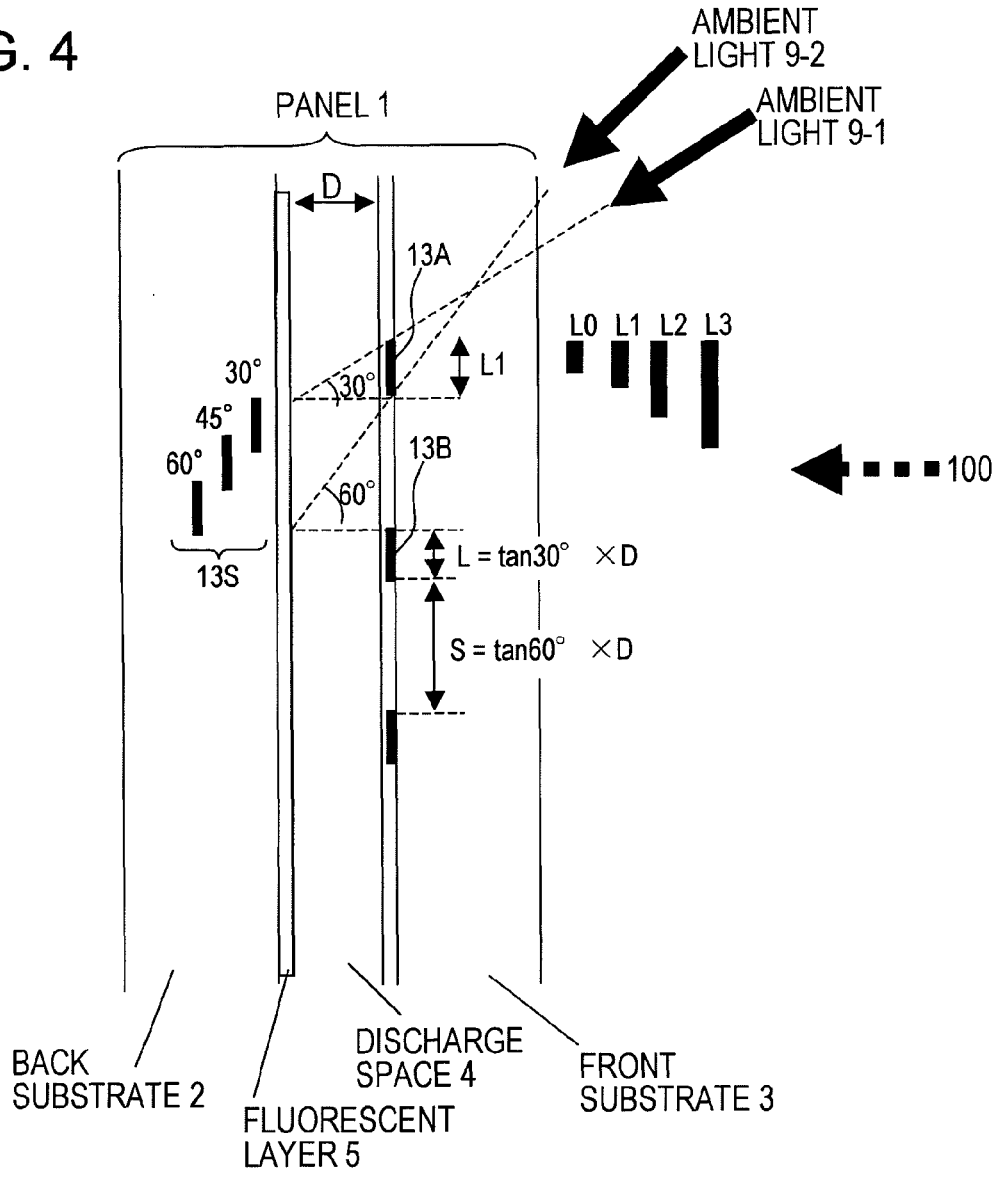
FIG. 4 is a drawing that explains the optimum range of the width L of the shielding films.
Figure 4:
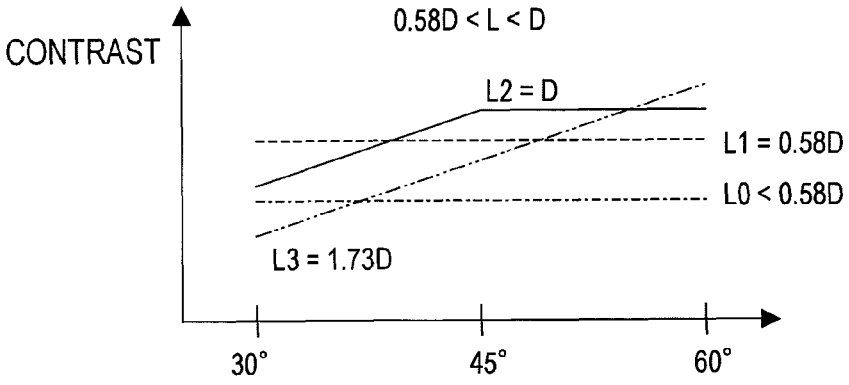

FIG. 4 is a drawing that explains the optimum range of the width L of the shielding films. The shielding films of the present embodiment are composed of a plurality of stripe-like shielding films, and determination of the optimum values of their width L and spacing S within the range of an incident angle of ambient light of 30° to 60° is not necessarily easy. The reason for this is that the width L, the spacing S and the incident angle are fluctuating factors, and it is necessary to find the case in which daylight contrast becomes high when determined using these as variables.

With respect to the width L of the shielding films, as the width L increases, the shadow 13S formed by the shielding film 13A ends up being concealed behind the shielding film 13A as viewed from the direction of observation 100, and the reflectance ratio of the ambient light decreases. In addition, with respect to the spacing S of the shielding films, as the spacing S becomes smaller, the shadow 13S formed by the shielding film 13A ends up being concealed behind the shielding film 13B, and the reflectance ratio of the ambient light similarly decreases. In other words, preventing the shadows 13S from being concealed behind the shielding films 13A and 13B reduces the quantity of ambient light reflected by the fluorescent layer 5 as viewed from the direction of observation 100. Accordingly, the case of contrast increasing is explained from the viewpoint of preventing the shadows 13S from being concealed behind the shielding films.

In FIG. 4, the range of the width L for which contrast increases is set on the premise that the spacing S is sufficiently large (S≧1.73D) and the shadow 13S is not concealed by the adjacent shielding film 13B. Contrast within the range of an ambient light incident angle of 30° to 60° is as shown in the graph shown in FIG. 4 for respective lengths L0<0.58D, L1=0.58D, L2=D and L3=1.73D of the shielding film 13A shown in FIG. 4.

First, in the case width L0<0.58D, since the shadow 13S is not concealed behind the shielding film 13A even at an incident angle of 30°, and is naturally not concealed at an incident angle of 45° or 60°, contrast (single-dot broken line) remains constant. However, since the width L0 is narrow, the reflectance ratio is high and contrast decreases.

In the case of width L1=0.58D as well, since the shadow 13S is not concealed behind the shielding film 13A even at an incident angle of 30°, and since it is naturally not concealed at an incident angle of 45° or 60°, contrast (broken line) remains constant. However, since the width L1 is larger than L0, reflectance ratio decreases as compared with the case of width L0 and contrast increases.

Next, in the case of width L2=D, the shadow 13S is not concealed behind the shielding film 13A between incident angles of 45° to 60° and contrast remains constant, and since the width L2 is larger than the width L1, the reflectance ratio decreases in comparison with the case of width L1 and contrast (solid line) is higher than in the case of L1. However, if the incident angle becomes smaller than 45°, since the shadow 13S is concealed behind the shielding film 13A, contrast decreases as the incident angle becomes increasingly less than 45°.

Finally, in the case of L3=1.73D, although the shadow 13S is not concealed behind the shielding film 13A if the incident angle is 60° and contrast is the highest, if the incident angle is less than 60°, the shadow 13S is concealed behind the shielding film 13A. Accordingly, since the reflectance ratio increases at an incident angle of less than 60°, contrast (double-dotted broken line) decreases.

As is indicated in the graph of FIG. 4, if the width L is such that 0.58D≦L≦D, comparatively high contrast can be expected to be obtained within the range of an incident angle of 30° to 60°. However, since the above-mentioned discussion is premised on the spacing S being sufficiently large, this result is not necessarily absolute. In addition, the hierarchical relationship between the contrast of L2 and L1 at an incident angle of 30° also has the possibility of inverting depending on other factors.

Figure 5:
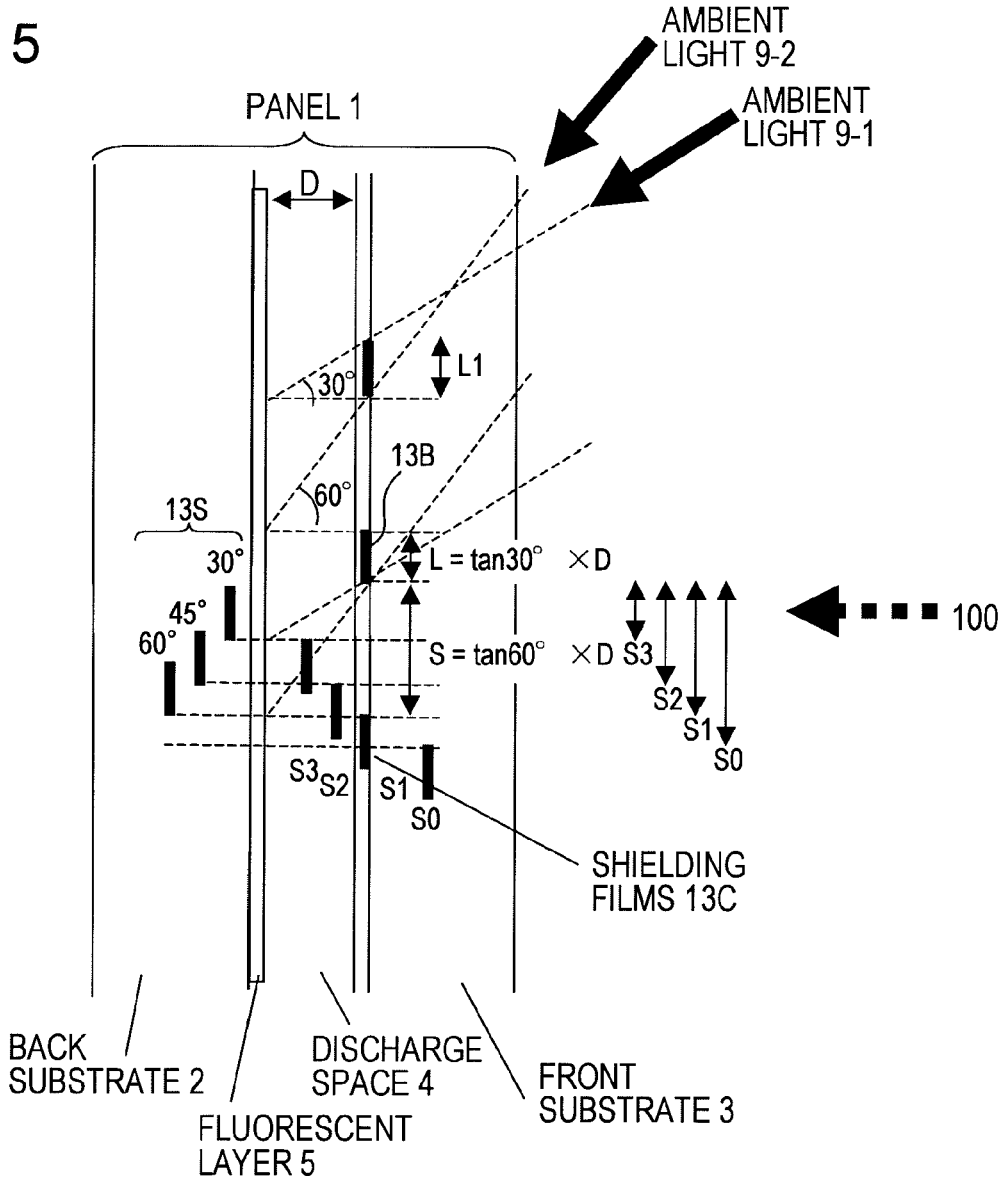
FIG. 5 is a drawing that explains the optimum range of the spacing S of the shielding films.
Figure 5:
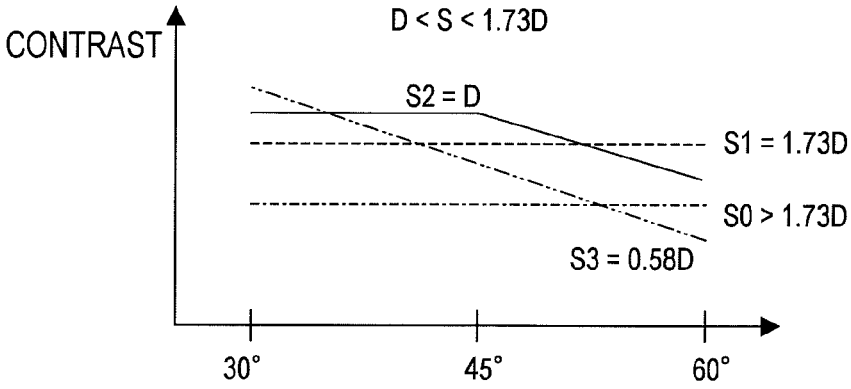

FIG. 5 is a drawing that explains the optimum range of the spacing S of the shielding films. Contrast within the range of an ambient light incident angle of 30° to 60° is as shown in the graph shown in FIG. 5 for respective spacings S0>1.73D, S1=1.73D, S2=D and S3=0.58D of the shielding film 13A shown in FIG. 5. However, the range of the spacing S for which contrast increases is examined based on the premise that the width L of the shielding films is sufficiently small (L≦0.58D), and that the shadow 13S is not concealed behind the shielding film 13B that formed that shadow.

First, in the case of S0>1.73D, since the shadow 13S formed by the shielding film 13B is not concealed behind an adjacent shielding film 13C within the range of an incident angle of 30° to 60°, the reflectance ratio remains constant and contrast (single-dot broken line) is also constant. In the case of S1=1.73D as well, since the shadow 13S is also not concealed behind the adjacent shielding film 13C within the range of an incident angle of 30° to 60°, the reflectance ratio remains constant and contrast (broken line) is also constant. However, since spacing S1 is narrower than S0, the reflectance ratio decreases and contrast is higher than in the case of S0.

Next, in the case of S2=D, since the shadow 13S formed by the shielding film 13B is concealed behind the adjacent shielding film 13C if the incident angle is 60°, the reflectance ratio increases and contrast (solid line) decreases. However, since the shadow 13S formed by the shielding film 13B is not concealed behind the adjacent shielding film 13C if the incident angle is within the range of 30° to 45°, reflection of ambient light can be effectively inhibited, the reflectance ratio decreases and contrast (solid line) increases.

Finally, in the case of S3=0.58D, although the shadow 13S is not concealed behind the adjacent shielding film 13C at an incident angle of 30°, it is concealed at other incident angles. Accordingly, the reflectance ratio decreases and contrast (double-dot broken line) also decreases as the incident angle becomes large.

As shown in the graph of FIG. 5, if the spacing S is such that D≦S≦1.73D, comparatively high contrast can be expected to be obtained within the range of an incident angle of 30° to 60°. However, since the above-mentioned discussion is premised on the width L being sufficiently small, this result is not necessarily absolute. In addition, the hierarchical relationship between the contrast of S2 and S1 at an incident angle of 60° also has the possibility of inverting depending on other factors.

[Embodiments]

Figure 6:
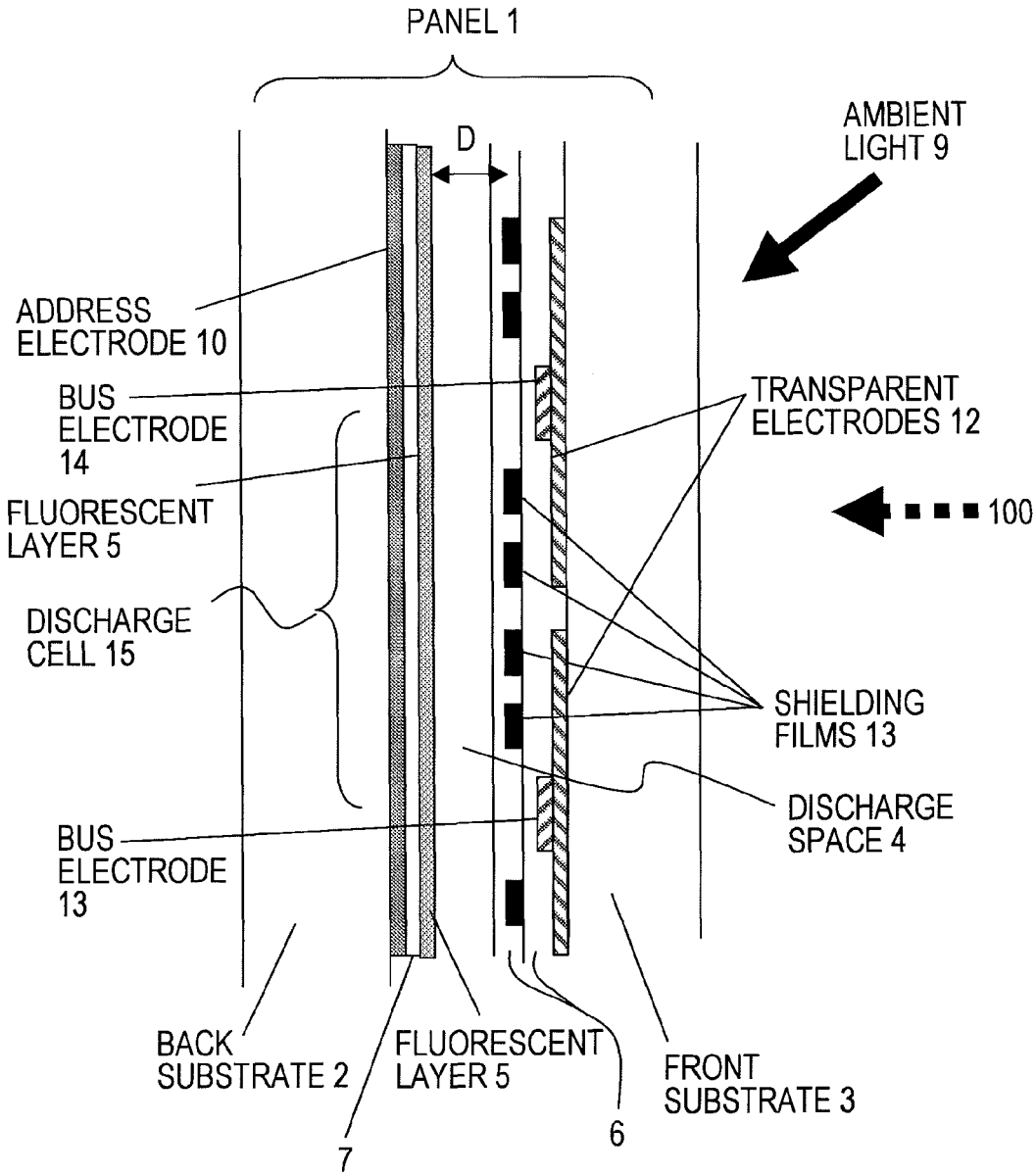
FIG. 6 is a cross-sectional view of a plasma display panel in a first embodiment of the present invention.
Figure 7:
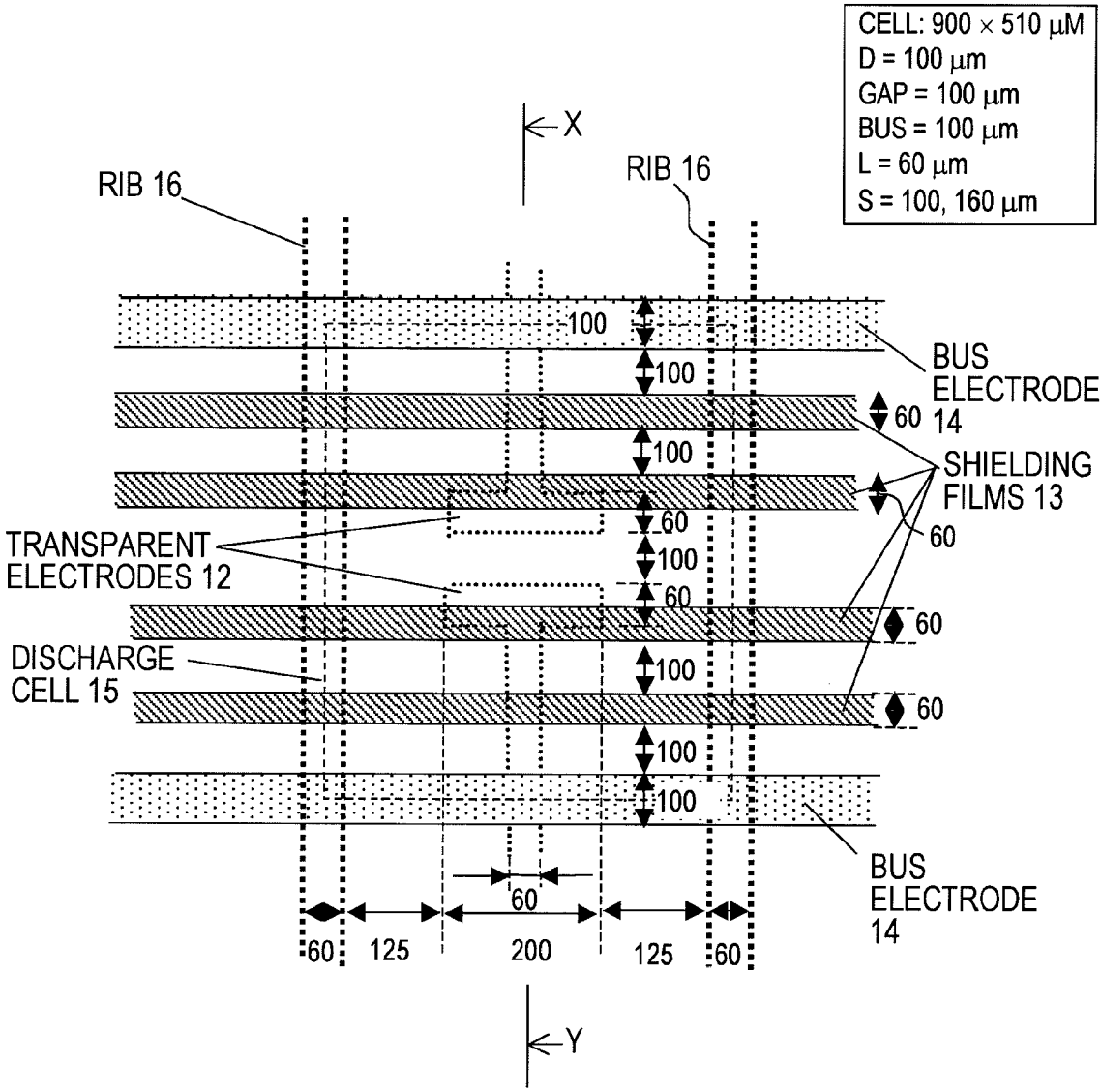
FIG. 7 is a plan view of a plasma display panel in a first embodiment of the present invention.

FIG. 6 is a cross-sectional view of a plasma display panel in a first embodiment of the present invention. In addition, FIG. 7 is a plan view thereof. A cross-section taken along X-Y in FIG. 7 is shown in FIG. 6. As shown in FIG. 6, an address electrode 10 that extends in the vertical direction is formed on the back substrate 2, and a dielectric layer 7 and the fluorescent layer 5 are formed thereon. In addition, as shown in FIG. 7, partitions (ribs) 16 that demarcate a discharge cell area 15 are formed between address electrodes on the back substrate 2. In the example of FIG. 7, the partitions (ribs) 16 are in a band-like pattern extending in the vertical direction of the panel.

On the other hand, electrically conductive transparent electrodes 12 and bus electrodes 14, which are composed of a metal layer having a Cr/Cu/Cr laminated structure, are formed on the front substrate 3, and a plurality of the stripe-like shielding films 13, which extend in the horizontal direction of the panel, are formed thereon with the dielectric layer 6 interposed therebetween. As shown in FIG. 7, the bus electrodes 14 are a plurality of stripe-like electrodes that extend in the horizontal direction along display lines, and serve as display electrodes of the panel. The bus electrodes 14 demarcate the discharge cell area 15 above and below, and the discharge cell area 15 is formed between a pair of the bus electrodes 14. In addition, the transparent electrodes 12 are formed from ITO, for example, and a shown in FIG. 7, have a T-shape that protrudes from the bus electrodes 14 into the discharge cell area 15. The transparent electrodes 12 connected to the upper and lower bus electrodes 14 are arranged in mutual opposition with a discharge gap interposed therebetween, and initiate discharge between the transparent electrodes 12. The transparent electrodes 12 and the bus electrodes 14 are covered with the dielectric layer 6 composed of a glass material and the like, the shielding films 13 there above are also covered with the dielectric layer 6, and a protective film of magnesium oxide and the like is formed on the surface of the dielectric layer 6.

The shielding films 13 are preferably separated from the display electrodes composed of the bus electrodes 14 and the transparent electrodes 12 by the dielectric layer 6. Separation of the shielding films 13 from the display electrodes 12 and 14 makes it possible to inhibit reaction with the display electrodes. However, the shielding films and the transparent electrodes may be formed while making contact.

The first embodiment is an example of a so-called ALiS type of panel that has respective discharge cell areas between the bus electrode 14 and a bus electrode adjacent thereto on one side and between the bus electrode 14 and a bus electrode adjacent thereto on the other side. Accordingly, display driving is carried out by interlacing.

The discharge cell area 15 is a rectangular area demarcated by the left and right partitions (ribs) 16 and the upper and lower bus electrodes 14 shown in FIG. 7, and has a size of 900×510 μm. Four shielding films 13 are formed in this discharge cell area 15. In addition, a distance D between the shielding films 13 and the surface of the fluorescent layer 5 of this panel is approximately 100 μm. The other specific sizes are shown in FIG. 7, and the width of the bus electrode 14 is 100 μm, the width L of the shielding films 13 is 60 μm, the spacing between the bus terminals and the shielding films is 100 μm, and the spacing S between the shielding films is 100 μm. However, the spacing S between the shielding films only in the center of the discharge cell area 15 is 160 μm. Since the bus electrodes 14 are made of a metal material composed of Cr/Cu/Cr, the bus electrodes themselves have a dark color and therefore also function as shielding films.

Since D=100 μm, the sizes of the width L and the spacing S can both be understood to be designed within the range of $0.58D \leqq L \leqq D$ and $D \leqq S \leqq 1.73D$.

In FIG. 7, although a sustain discharge occurs within the discharge cell 15, the distribution of the quantity of display light tends to be such that the quantity of display light is highest in the center of the discharge cell and decreases moving closer to the periphery. Therefore, by making the width L of the shielding films in the center of the discharge cell 15 narrower than the width of the shielding films near the bus electrodes 14, the quantity of display light can be increased, thereby making it possible to increase contrast. Conversely, by making the spacing S of shielding films near the center of the discharge cell 15 wider than the spacing S of shielding films near the bus electrodes 14, the quantity of display light can also be increased, thereby making it possible to increase contrast. The conditions described above are preferably achieved by combining the width L and spacing S of the shielding films. Moreover, the spacing S of the shielding films only in the center of the discharge cell area is preferably made to be wider than the range of $D \leqq S \leqq 1.73D$. In other words, the spacing S is exceptionally increased only in the center of the discharge cell area, thereby making it possible to decrease the quality of display light that is shielded.

Figure 8:
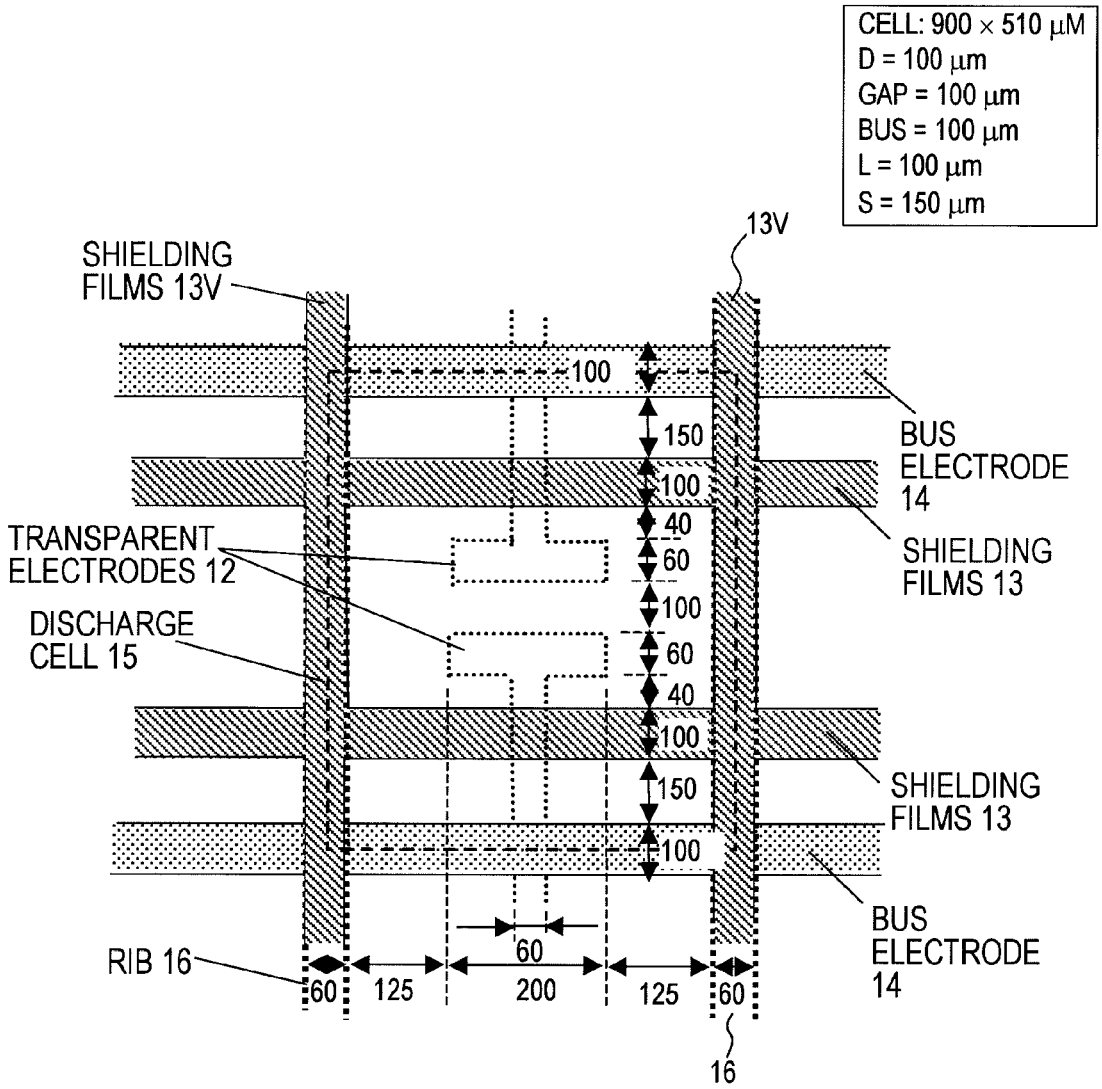
FIG. 8 is a plan view showing a variation of the plasma display panel of the first embodiment.

FIG. 8 is a plan view showing a variation of the plasma display panel of the first embodiment. In this variation, the bus electrodes 14, the transparent electrodes 12, the partitions (ribs) 16 and the discharge cell 15 are the same as in FIG. 7. However, shield films 13V are also formed on the front substrate at the locations of the stripe-like partitions (ribs) 16. Since the partitions (ribs) 16 are normally formed by baking glass paste, they are transparent or translucent, and shielding films 13V are preferably additionally formed at those locations as well. Moreover, two shielding films 13 are formed between the upper and lower bus electrodes 14, and in comparison with FIG. 7, the two shielding films 13 formed in the center of the discharge cell 15 are eliminated. In order to compensate for this, the gap between the bus electrodes 14 and the shielding films 13 is increased to 150 μm. In such a configuration as well, the shielding means composed of the dark-colored bus electrodes 14 and the plurality of shielding films 13 therebetween is designed within the range of $0.58D \leqq L \leqq D$ and $D \leqq S \leqq 1.73D$, excluding the center of the discharge cell, thereby making it possible to increase contrast. However, the above-mentioned S corresponds to the spacing between the bus electrodes 14 and the shielding films 13, while L corresponds to the width of the bus electrodes and shielding films.

Figure 9:
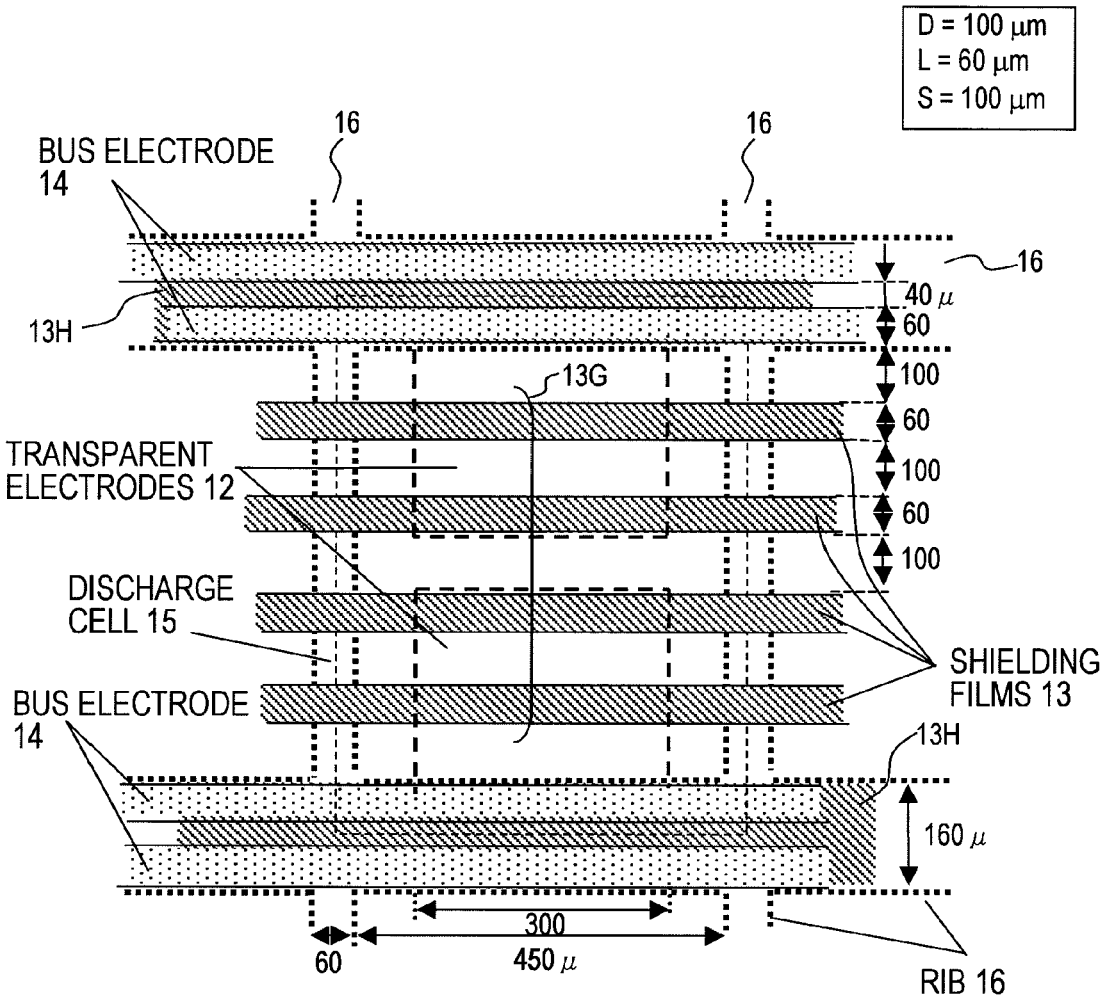
FIG. 9 is a plan view of a plasma display panel in a second embodiment.

FIG. 9 is a plan view of a plasma display panel in a second embodiment. The second embodiment differs from the first embodiment in that the partitions (ribs) 16 formed on the back substrate have the form of a lattice. In this embodiment, the partitions (ribs) 16 have a partition structure referred to as a so-called box rib structure, and the discharge cell 15 is demarcated by partitions 16 to the left and right as well as above and below. In addition, the bus electrodes 14 extending in the horizontal direction in the form of display electrodes are provided at the locations of those partitions that extend in the horizontal direction. Four stripe-like shielding films 13 are formed in the discharge cell area 15 between the upper and lower bus electrodes 14. The width L and spacing S of the four shielding films 13 are of the sizes shown in the drawing, and are within the range of $0.58D \leqq L \leqq D$ and $D \leqq S \leqq 1.73D$. In addition, the gaps between the bus electrodes 14 and the shielding films 13 as well as the width of the bus electrodes are also within the range of $0.58D \leqq L \leqq D$ and $D \leqq S \leqq 1.73D$.

Moreover, in the case of box ribs, shielding films 13H are additionally formed at the locations of the partitions 16 that extend in the horizontal direction. In this second embodiment, pairs of upper and lower bus electrodes 14 are provided corresponding to each display line, and rectangular transparent electrodes 12, which are arranged in the discharge cell area 15, are formed electrically connected to the bus electrodes 14. In addition, two bus electrodes 14 are formed corresponding to upper and lower discharge cells 15 on the partitions 16 that extend in the horizontal direction. Accordingly, in this panel, display driving is carried out using a non-interlacing method. Shielding films 13 are also provided at the locations of the partitions 16 that extend in the horizontal direction.

Figure 10:
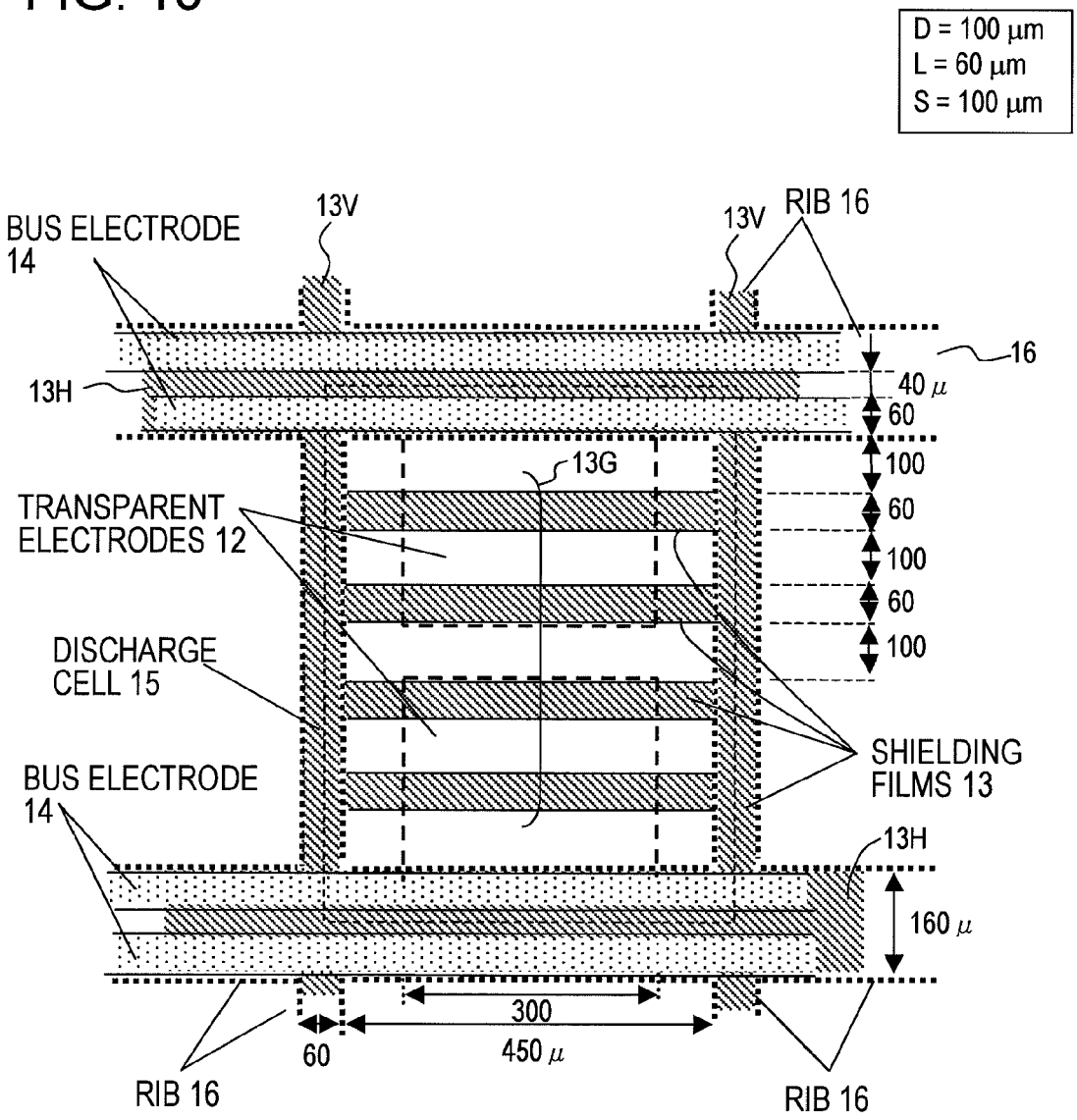
FIG. 10 is a plan view of a variation of the plasma display panel of the second embodiment.

FIG. 10 is a plan view of a variation of the plasma display panel of the second embodiment. This configuration differs from that of FIG. 9 in that the shielding films 13 arranged in a display cell 15 have the same length as the width of the discharge cell 15, additional shielding films 13V are arranged at the locations of the partitions (ribs) 16 that extend in the vertical direction, and a plurality of shielding films 13 are linked with the additional shielding films 13V. Other constituents such as the box ribs 16, the additional shielding films 13H, the rectangular transparent electrodes 12 and the use of a non-interlace type are the same as FIG. 9. In addition, the plurality of shielding films 13 are such that, including the gap between the shielding films 13 and the bus electrodes 14, the width L and the spacing S are within the range of $0.58D \leqq L \leqq D$ and $D \leqq S \leqq 1.73D$.

In the second embodiment shown in FIGS. 9 and 10 as well, the widths and spacing of the plurality of shielding films 13 in the discharge cell area may be narrower and wider, respectively, in the center of the discharge cell area, thereby making it possible to increase the quantity of display light and increase contrast.

Figure 11:
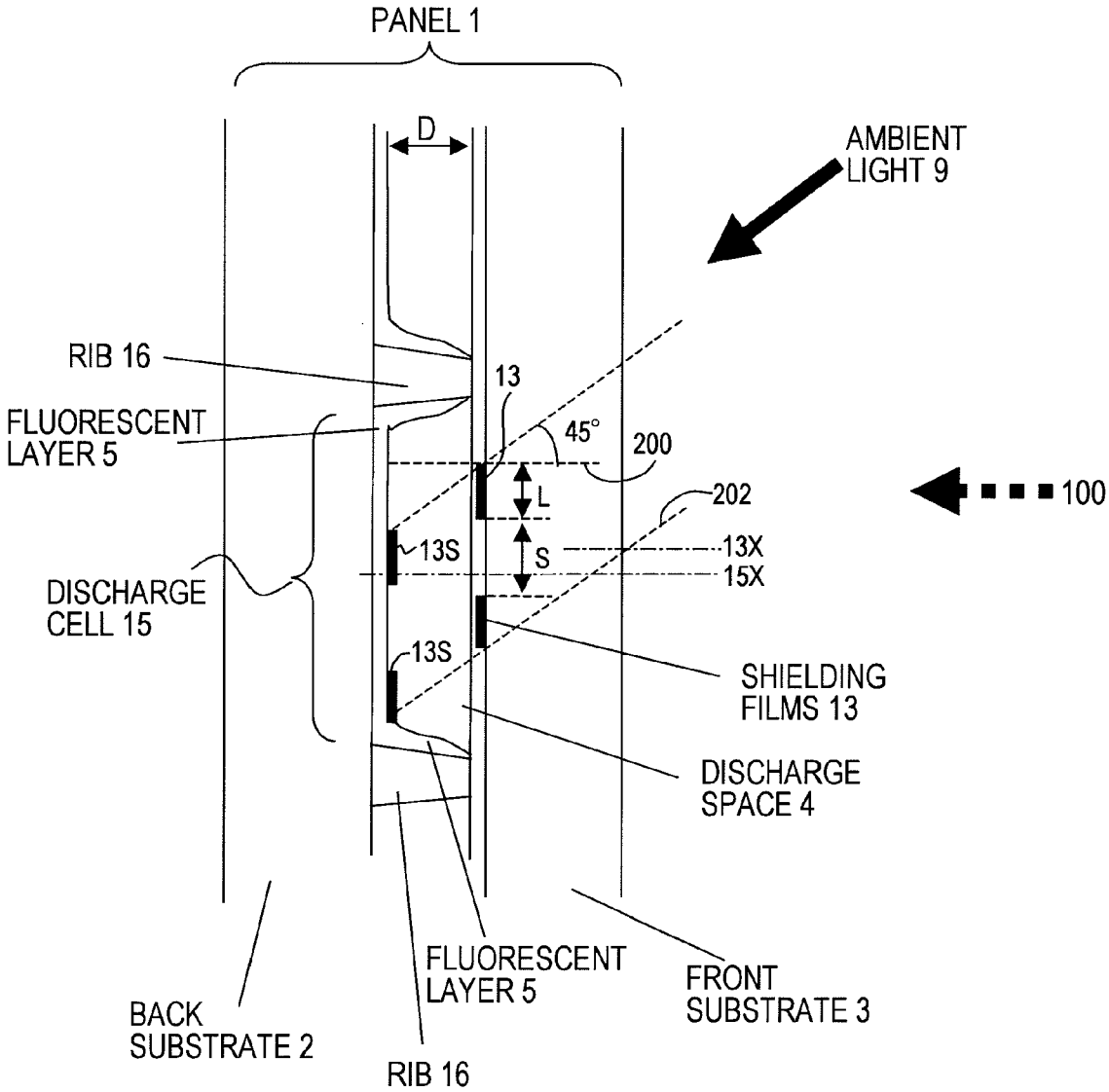
FIG. 11 is a cross-sectional view of a plasma display panel of a third embodiment.

FIG. 11 is a cross-sectional view of a plasma display panel of a third embodiment. This panel has a box rib structure as shown in FIGS. 9 and 10, and is applied to a structure having transparent electrodes formed overlapping the bus electrodes. As shown in FIG. 11, in this box rib structure, the partitions (ribs) 16 are formed above and below the discharge cell area 15, and the fluorescent layer 5 is formed to over the sidewalls of the partitions (ribs) 16. Extending the fluorescent layer 5 to the sidewalls of the partitions (ribs) 16 makes it possible to increase emission intensity.

As shown in FIG. 11, a center position 13X of the plurality of stripe-like shielding films 13 arranged in the discharge cell area 15 is shifted upward from a center position 15X of the discharge cell 15. However, the location of the upper ends of the plurality of shielding films 13 is arranged lower than the fluorescent layer 5 on the sidewalls of the partitions (ribs) 16. As a result, since first, the center position 13X of the plurality of shielding films is shifted upward from the center position 15X of the discharge cell, the shadows 13S of the shielding films 13 formed by ambient light 9 entering diagonally from above (the shadow formed along broken line 202) can be prevented from being projected onto the fluorescent layer 5 on the sides of the partitions. If the shadows 13S are projected onto the fluorescent layer 5 on the sides of the partitions, the area of the shadows 13S as viewed from the direction of observation 100 becomes smaller, and reflection inhibition efficiency of the ambient light decreases. In addition, since the locations of the upper ends of the plurality of shielding films 13 are arranged lower than the fluorescent layer 5 on the sidewalls of the partitions (ribs) 16, when viewed from the direction of observation 100, the shielding films 13 are able to effectively block reflected ambient light that enters the fluorescent layer 5 at flat locations on the back substrate 2 as indicated by broken line 200. Since the amount of reflected ambient light at the fluorescent layer 5 on the sidewalls of the partitions 16 at the upper end of the discharge cell 15 is not so large that reflection inhibitory effects of ambient light are small even if shielding films 13 are formed at those locations.

According to the embodiment shown in FIG. 11, the positions of a shielding film unit 13G, which is composed of the four shielding films 13 shown in FIGS. 9 and 10, is shifted upward, while the center position of the shielding film unit 13G and the center position of the discharge cell 15 are shifted as shown in FIG. 11.

Figure 12:
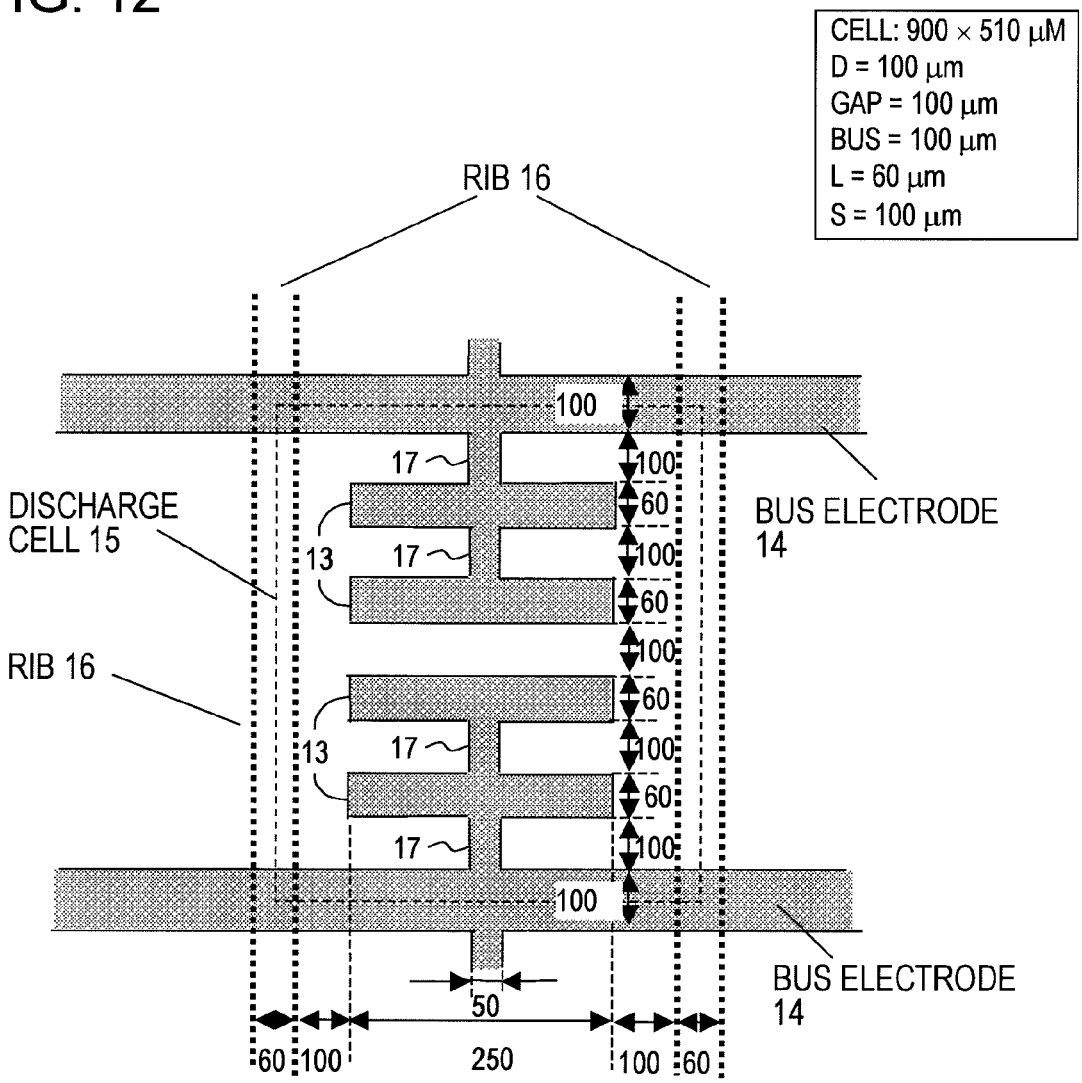
FIG. 12 is a plan view of a plasma display panel of a fourth embodiment.

FIG. 12 is a plan view of a plasma display panel of a fourth embodiment. In this embodiment, transparent electrodes are not provided, and the display electrodes are composed of bus electrode materials only. The bus electrodes 14 are integrally formed with two stripe-like electrode/shielding films 13 and connecting portions 17, which connect the shielding films 13 and the bus electrodes 14, arranged in the discharge cell area 15. Namely, the bus electrodes 14 extending in the horizontal direction of the panel have above and below units composed of two shielding films 13 and connecting portions 17 corresponding to each cell area 15. These are integrally formed by, for example, a dark-colored metal layer structure of a Cr/Cu/Cr laminated structure.

FIG. 12 indicates an ALiS panel in which the discharge cells 15 are present between all of the adjacent bus electrodes 14 in the same manner as FIGS. 7 and 8. The shielding films 13 respectively connected to the upper and lower bus electrodes 14 are in close proximity in the discharge cell 15. Accordingly, when a sustain discharge voltage is applied to the upper and lower bus electrodes 14, discharge begins between adjacent shielding films 13. In other words, the plurality of shielding films 13 also have the function of a sustain electrode in addition to a light shielding function. Accordingly, the widths and spacing of the bus electrodes 14 and the plurality of stripe-like sustain electrodes (shielding films) 13 are designed to have suitable values so as to decrease the reflectance ratio of ambient light.

The width L=60 μm and spacing S=100 μm of the four shielding films 13 in the discharge cell 15 are both within the range of $0.58D \leqq L \leqq D$ and $D \leqq S \leqq 1.73D$ at D=100 μm. In addition, a width of 100 μm for the bus electrodes 14 and a spacing of 130 μm between the bus electrodes 14 and the shielding films 13 are also within the range of $0.58D \leqq L \leqq D$ and $D \leqq S \leqq 1.73D$. Thus, in the example of FIG. 12, the reflectance ratio of ambient light can be decreased and contrast can be enhanced by employing a structure composed of the bus electrodes 14 and the shielding films 13.

Figure 13:
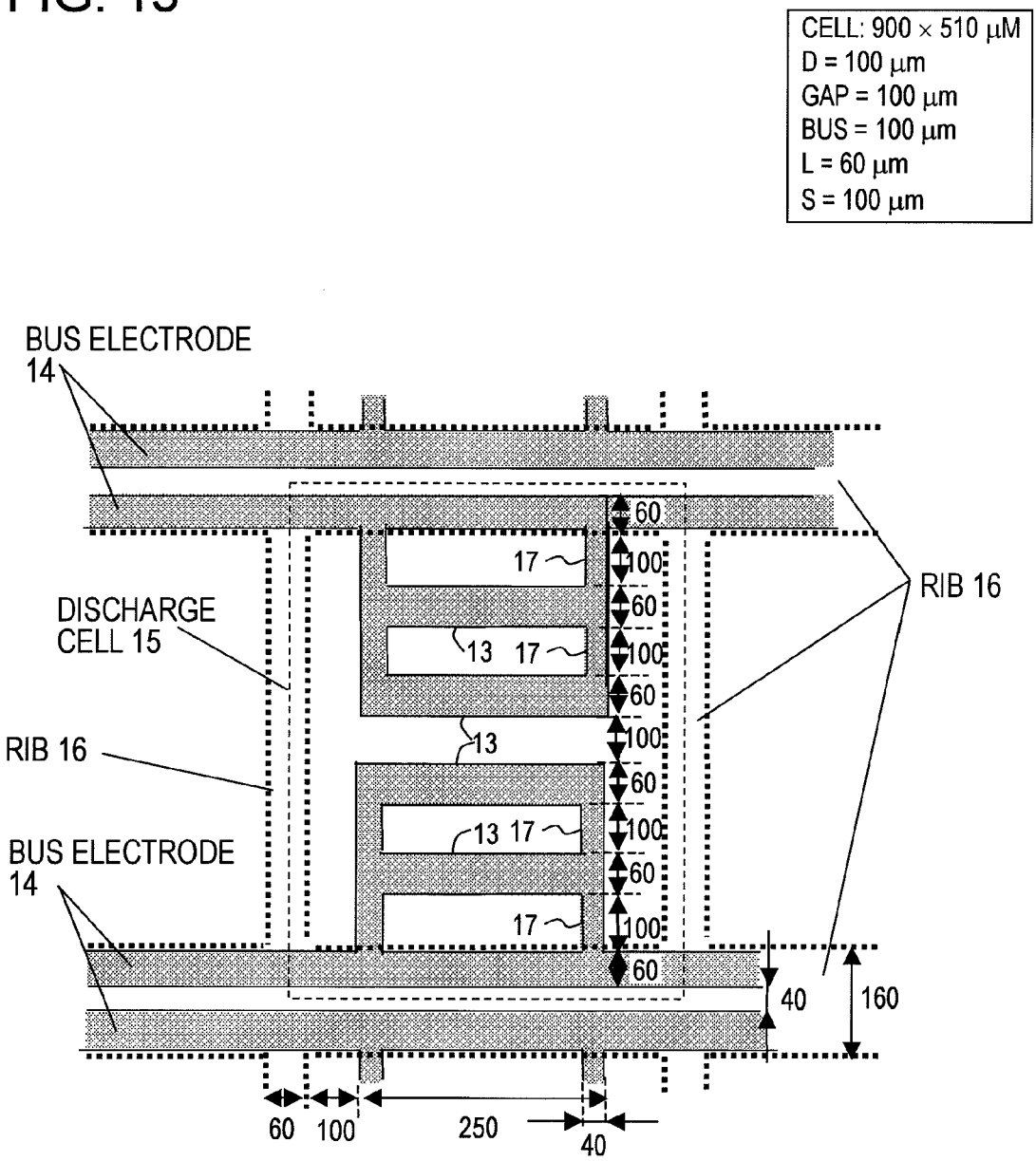
FIG. 13 is a plan view of a variation of the plasma display panel of the fourth embodiment.

FIG. 13 is a plan view of a variation of the plasma display panel of the fourth embodiment. This panel employs a box rib structure and differs from FIG. 12 in that is of the non-interlace type in which a pair of bus electrodes 14 are provided for each discharge cell 15. The integral formation of the bus electrodes 14, which employ a dark-colored metal layer structure, the shielding films 13 and the connecting portions 17, without providing transparent electrodes, is the same as FIG. 12. However, the connecting portions 17, which connect the shielding films with the other shielding films and further connect the shielding films with the bus electrodes 14, differ from FIG. 12 in that they are respectively formed to the left and right of the shielding films 13.

The pairs of bus electrodes 14 are arranged at the locations of those ribs 16 extending in the horizontal direction, and the width of the bus electrodes 14 is 60 μm. In addition, the width of 60 μm spacing of 100 μm of the plurality of shielding films 13, the gap between the shielding films and the bus electrodes of 100 μm, and the width of the bus electrodes of 60 μm are all within the range of $0.58D \leqq L \leqq D$ and $D \leqq S \leqq 1.73D$.

The fourth embodiment shown in FIGS. 12 and 13 contributes to reduced costs since it is not provided with transparent electrodes. Even if the shielding films 13 composed of dark-colored metal electrodes are arranged over the entire area of the discharge cell 15, the reflectance ratio of ambient light entering diagonally from above the panel can be inhibited according to the principle described above, thereby making it possible to improve daylight contrast. In FIGS. 12 and 13, the bus electrodes 14 and the shielding films 13 can be formed by the same film forming step and patterning step, thereby realizing a simple configuration and contributing to reduced costs.

In the fourth embodiment of FIGS. 12 and 13, the width and spacing of the plurality of shielding films 13 in the discharge cell 15 may have a narrower width and wider spacing in the center of the discharge cell as compared with the periphery in order to take advantage of display light having high emission intensity in the center of the discharge cell 15. Moreover, the spacing S of the shielding films 13 only in the center of the discharge cell 15 may be partially wider than the range of $D \leqq S \leqq 1.73D$ to enhance transmittance of display light attributable to emission in the center of the discharge cell 15.

As has been explained above, according to this embodiment, a plurality of dark-colored, stripe-like shielding films are provided in a discharge cell area between display electrodes extending in the horizontal direction of a panel, and the width L and spacing S of this plurality of shielding films are designed to be within the ranges indicated above. As a result, daylight contrast can be improved in comparison with the case of providing a filter over the entire surface of the panel.

INDUSTRIAL APPLICABILITY

A plasma display panel having high daylight contrast can be provided.

The invention claimed is:

1. A plasma display panel comprising:

a front substrate and a back substrate arranged opposed to each other with a discharge space interposed therebetween, wherein a fluorescent layer is formed on the back substrate, a plurality of display electrodes extending in the horizontal direction are formed on the front substrate, and a discharge cell area is demarcated corresponding to the display electrodes, a plurality of shielding films extending in the horizontal direction are respectively formed between the display electrodes and within the discharge cell area on the front substrate, and when the distance between the shielding films and the fluorescent layer in the discharge space is defined as D, then a width L of the shielding films and a spacing S of the shielding films satisfy the relationships of $0.58D \leqq L \leqq D$ and $D \leqq S \leqq 1.73D$.

2. The plasma display panel according to claim 1, wherein the plurality of display electrodes are bus electrodes containing a metal material, and a width Ld of the plurality of display electrodes and a spacing Sd between the display electrodes and the shielding films adjacent thereto satisfy the relationships of $0.58D \leqq L \leqq D$ and $D \leqq S \leqq 1.73D$.

3. The plasma display panel according to claim 1, wherein the plurality of display electrodes are electrically conductive bus electrodes containing a metal material, transparent electrodes connected to the bus electrodes are formed in an area between the bus electrodes on the front substrate, and the plurality of shielding films are in the form of stripes and are arranged in the area between the bus electrodes.

4. The plasma display panel according to claim 3, wherein the plasma display panel has stripe-like partitions extending in the vertical direction on the back substrate, and the discharge cell area is demarcated by the partitions and the bus electrodes, and additional shielding films corresponding to the locations of the partitions are formed on the front substrate.

5. The plasma display panel according to claim 3, wherein the plasma display panel has lattice-like partitions on the back substrate, and the discharge cell area is surrounded by the lattice-like partitions, and additional shielding films corresponding to the locations of the partitions are formed on the front substrate.

6. The plasma display panel according to claim 3, wherein the plasma display panel has lattice-like partitions on the back substrate, and the discharge cell area is surrounded by the lattice-like partitions, and the center of a shielding film unit composed of the plurality of shielding films is shifted upward from the center of the discharge cell area.

7. The plasma display panel according to claim 6, wherein the upper end of the shielding film unit is located lower than the fluorescent layer formed on sidewalls of the lattice-like partitions, and the shielding film unit is arranged so that shadows of the shielding films on the fluorescent layer formed by ambient light entering at a prescribed angle are located higher than the fluorescent layer formed on the sidewall of the lattice-like partition.

8. The plasma display panel according to claim 1, wherein the plurality of display electrodes are electrically conductive bus electrodes, the plurality of shielding films are formed with an electrically conductive material, and a first shielding film and a second shielding film among the plurality of shielding films are respectively connected to a pair of the adjacent bus electrodes by connecting portions.

9. The plasma display panel according to claim 8, wherein the plasma display panel has stripe-like partitions extending in the vertical direction on the back substrate, and the discharge cell area is demarcated by the partitions and the bus electrodes, and additional shielding films corresponding to the locations of the partitions are formed on the front substrate.

10. The plasma display panel according to claim 8, wherein the plasma display panel has lattice-like partitions on the back substrate, and the discharge cell area is surrounded by the lattice-like partitions, and additional shielding films corresponding to the locations of the partitions are formed on the front substrate.

11. The plasma display panel according to claim 1, wherein the plurality of shielding films provided in the discharge cell area have a distance between the shielding films in the center of the discharge cell area that is longer than a distance between shielding films at the upper and lower edges of the discharge cell area.

12. The plasma display panel according to claim 1, wherein the plurality of shielding films provided in the discharge cell area have a width of the shielding films in the center of the discharge cell area that is narrower than a width of the shielding films at the upper and lower edges of the discharge cell area.

13. The plasma display panel according to claim 1, wherein the plurality of shielding films provided in the discharge cell area have a spacing S between the shielding films that does not satisfy the relationship of $D \leqq S \leqq 1.73D$ only in the center of the discharge cell area.

14. A plasma display panel comprising:

a front substrate and a back substrate arranged opposed to each other with a discharge space interposed therebetween, wherein a fluorescent layer is formed on the back substrate, a plurality of display electrodes extending in the horizontal direction are formed on the front substrate, and a discharge cell area is demarcated corresponding to an area between adjacent display electrodes, the display electrodes have a plurality of light-shielding sustain electrodes extending in the horizontal direction and arranged on the discharge cell area, and connecting portions that extend from the display electrodes and connect the plurality of light-shielding sustain electrodes, and when the distance between the light-shielding sustain electrodes and the fluorescent layer in the discharge space is defined as D, then a width L of the light-shielding sustain electrodes and a spacing S of the light-shielding sustain electrodes satisfy the relationships of $0.58D \leqq L \leqq D$ and $D \leqq S \leqq 1.73D$.

15. The plasma display panel according to claim 14, wherein the electrodes extending in the horizontal direction, the light-shielding sustain electrodes and the connecting portions of the display electrodes are formed with the same metal material.

* * * * *